US005988686A

United States Patent [19]

Teixido

[11] Patent Number: 5,988,686

[45] Date of Patent: Nov. 23, 1999

[54] BOOK DISPLAY METHOD

[76] Inventor: Ruben A. Teixido, 145 Dickinson La., Wilmington, Del. 19807

[21] Appl. No.: 09/072,999

[22] Filed: May 6, 1998

[51] Int. Cl.[6] ..... B42D 3/00

[52] U.S. Cl. ..... 281/45; 40/610; 248/460; 248/465.1; 281/33

[58] Field of Search ..... 40/610; 248/460, 248/465.1; 281/33, 43, 45

[56] References Cited

U.S. PATENT DOCUMENTS

| | | | |
|---|---|---|---|
| 353,582 | 11/1886 | Palmer | 248/453 |
| 419,605 | 1/1890 | Hiller | 40/761 |
| 869,110 | 10/1907 | Tibbetts | 248/453 |
| 3,999,734 | 12/1976 | Gibson et al. | 248/460 |
| 4,279,105 | 7/1981 | Cameron | 40/610 |
| 5,029,784 | 7/1991 | Blahout | 248/166 |
| 5,251,935 | 10/1993 | Bottiglieri | 281/45 |
| 5,720,466 | 2/1998 | Skipper | 248/460 |
| 5,765,799 | 6/1998 | Weber | 248/453 |
| 5,797,578 | 8/1998 | Graffeo et al. | 248/453 |

*Primary Examiner*—Andrea L. Pitts
*Assistant Examiner*—Monica Smith
*Attorney, Agent, or Firm*—Huntley & Associates

[57] ABSTRACT

A method for displaying a book using a book display that is easily transported, and involving a cord with stops at each end.

6 Claims, 1 Drawing Sheet

BOOK DISPLAY METHOD

BACKGROUND OF THE INVENTION

Current book displays are cumbersome and difficult to transport. Many book displays available today are incapable of being moved from site to site easily. These book displays are often heavy and require considerable assembly and disassembly in order to be moved.

SUMMARY OF THE INVENTION

The present invention provides a method for displaying a book comprising:

a) placing an elongate flexible member on a planar surface, the elongate flexible member having a first end and a second end, each end having a stopping device attached thereto;

b) setting a first object on the elongate flexible member between the first and second ends; and c) setting a book on the planar surface such that a lower edge of the book is in contact with at least one of the stopping devices on the elongate flexible member and at least a portion of a cover of the book is in contact with the first object.

DETAILED DESCRIPTION OF THE INVENTION

The present invention provides a simple, easily transportable, and inexpensive method for displaying a book. The book thus displayed may be opened in order to allow the book to be read while in the display.

Figure 1:
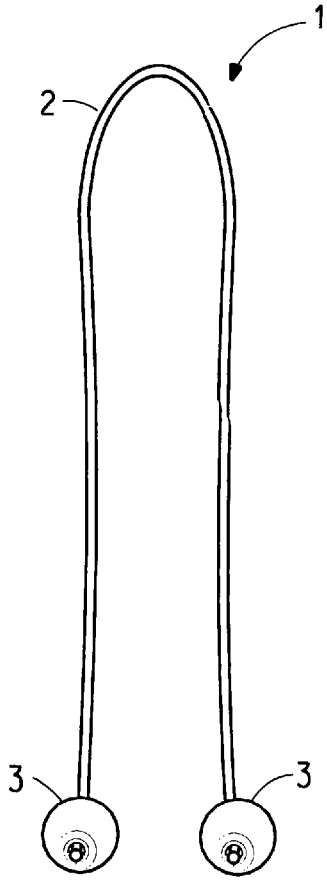
FIG. 1 shows a book display according to the present invention.

As shown in FIG. 1, the book display means 1 consists of elongate flexible member 2. This member can be made of a wide variety of materials such as cordage made of leather, hemp, braided thread, cloth, yarn, plastic and synthetic materials. It is preferable that elongate flexible member 2 be made of a material with sufficient flexibility so that the book display can be easily carried and stored. An especially preferred material is leather.

The length of elongate flexible member 2 can vary widely depending upon the size of the book to be displayed. Typically, elongate flexible member 2 will be about from 12 to 30 inches in length.

Attached to either end of elongate flexible member 2 are stopping devices 3. The stopping devices can be made from a wide variety of materials, including wood, leather, plastic, glass, and metal. A preferred material is wood. The stopping devices can be any desired shape, including geometric shapes such as spherical, cubic and conical. The stopping devices should be large enough so that a book can rest against the stopping device. A preferred shape for the stopping devices is a sphere.

The stopping devices can be attached to the elongate flexible member in any fashion provided that the method of attachment is strong enough to prevent separation of the stopping devices from the elongate flexible member when a book is being displayed. Representative methods of attachment include stapling and gluing. A preferred method of attachment is to provide openings in stopping devices 3, passing end portions of elongate flexible member 2 through the openings and applying glue to adhere the ends of elongate flexible member 2 to stopping devices 3.

Figure 2:
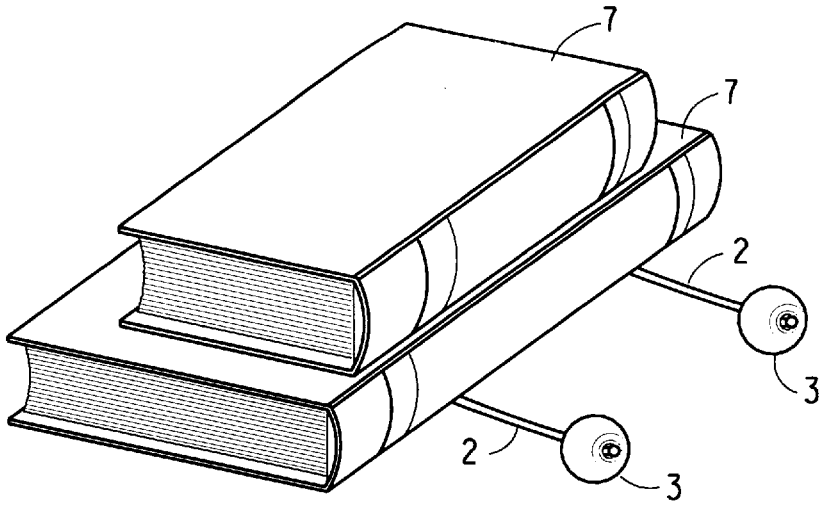
FIGS. 2 and 3 show a book display according to the present invention with books being displayed.
Figure 3:
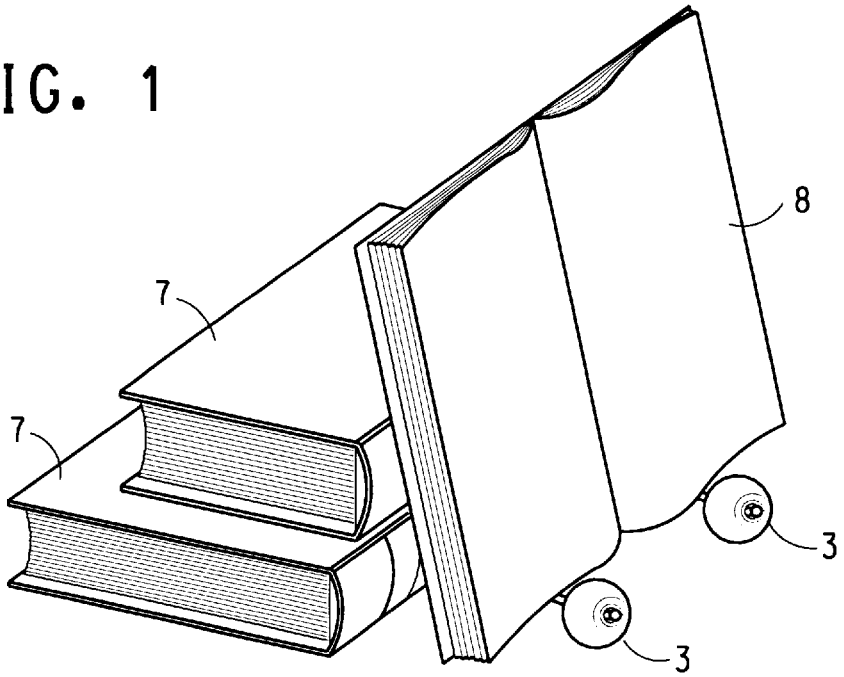

A method for using the book display is illustrated in FIGS. 2 and 3. Generally, book display means 1 is placed on a substantially planar surface. A first object 7, which can be a book as shown in FIG. 2, is placed on elongate flexible member 2 between the stopping devices 3. If object 7 is a book, as shown, it can be left in a closed position and serves to hold book display means 1 in place. A variety of objects, such as a block of wood, can be used as object 7 as long as the object has sufficient weight to hold book display means 1 in place and also has a surface or edge upon which a book to be displayed can rest. More than one object or book, as shown in FIG. 2, can be used.

In accordance with the present invention, book 8 is placed in an inclined position such that a portion of book 8 is in contact with object 7 and a lower edge of book 8 is in contact with at least one of the stopping devices 3. In this way, book 8 is held in the inclined position. The length of elongate flexible member 2 which extends beneath or beyond object 7 can be adjusted such that the angle of book 8 can be changed.

Other methods of using the book display of the present invention can be envisioned by one skilled in the art without exceeding the scope of the following claims. For example, the length of elongate flexible member 2 can be extended such the portion of elongate flexible member 2 extending beyond object 7 can be flipped over and used as a bookmark in book 8, the book being displayed.

I claim:

1. A method for displaying a book comprising:

a) placing an elongate flexible member on a planar surface, the elongate flexible member having a first end and a second end, the first end having a first stopping device attached thereto and the second end having a second stopping device attached thereto;

b) setting a first object on the elongate flexible member between the first and second ends; and c) setting a book on the planar surface such that a lower edge of the book is in contact with at least one of the stopping devices on the elongate flexible member and at least a portion of a cover of the book is in contact with the first object.

2. A method of claim 1 wherein the first object is a book.

3. A method of claim 1 wherein the elongate flexible member is a cord of material selected from the group consisting of leather, hemp, braided thread, cloth, yarn, plastic and synthetic materials.

4. A method of claim 1 wherein the stopping devices are geometric shapes made of material selected from the group consisting of wood, leather, plastic, glass and metal.

5. A method of claim 4 wherein the stopping devices are spheres.

6. A method of claim I wherein the stopping devices are attached to the elongate flexible member by passing the first end through an opening in the first stopping device and the second end through an opening in the second stopping device and gluing each end portion to one of the stopping devices.

* * * * *